United States Patent [19]

McGee

[11] 4,032,725

[45] June 28, 1977

[54] SPEAKER MOUNTING

[75] Inventor: Paul Dean McGee, Medinah, Ill.

[73] Assignee: Motorola, Inc., Schaumburg, Ill.

[22] Filed: Sept. 7, 1976

[21] Appl. No.: 721,010

[52] U.S. Cl. ..... 179/146 R; 248/27.1; 179/178

[51] Int. Cl.[2] ..... H04R 1/02; G12B 9/04

[58] Field of Search ..... 179/146 R, 115.5, 178; 248/27.1

[56] References Cited

UNITED STATES PATENTS

| | | | |
|---|---|---|---|
| 3,369,784 | 2/1968 | Whitney | 248/27.1 |
| 3,859,480 | 1/1975 | Birkner | 179/178 |

*Primary Examiner*—William C. Cooper

*Attorney, Agent, or Firm*—James W. Gillman; Donald J. Lisa; Patrick T. King

[57] ABSTRACT

Speaker mounting apparatus for front mounting a speaker to a panel of an automobile or recreational vehicle, including a base containing an opening for the speaker cone support and a peripheral flange containing recesses into which are snapped the tabs of a retainer ring which holds a speaker cover which decoratively covers the speaker and the mounting hardware. The base can be independently mounted to the panel and the speaker mounted to mounting posts. Alernatively, single screws can be used to simultaneously attach both the speaker and the housing to the panel.

9 Claims, 3 Drawing Figures

SPEAKER MOUNTING

BACKGROUND OF THE INVENTION

This invention relates generally to mounting apparatus for speakers and more particularly to apparatus for front mounting a speaker to a panel having a speaker cut-out hole in an automobile or a recreational vehicle.

Conventionally, apparatus for mounting a speaker to an automobile or a recreational vehicle involves mounting the speaker from the rear side of a panel with screws extending through the panel and into fasteners secured from the rear side of the panel. In many cases access to the rear side of a panel is difficult and awkward, especially in recreational vehicles with limited wall space. In some cases the panel must be disassembled for speaker mounting.

Some apparatus exists which includes a base portion attached to a panel from the front of the panel. A grill is placed over the base portion and fastened to the base with screws, the ends of which are exposed to view, detracting from the appearance of the unit.

Other prior art includes a metal ring with a central opening and an outstanding peripheral flange which is mounted to a panel. A resilient ring holding a speaker cover snaps over the base flange and is releasibly secured to the base.

Front mounting apparatus exists which includes a plastic grill molded into a front cover with the front cover being assembled to a base by means of hooked tabs engaging slots. This apparatus has the disadvantages of having a plastic grill which affects accoustic performance, aesthetic appeal, and styling flexibility.

The prior art shortcomings of difficult, awkward rear mounting methods, exposed fasteners, impaired accoustic performance, and limited styling flexibility have been overcome by the present invention.

SUMMARY OF THE INVENTION

It is a primary object of the present invention to provide snap-fit apparatus for easily front-mounting a speaker to a panel and for hiding the mounting means from view with an aesthetically appealing speaker cover.

It is another object of the invention to provide a speaker front-mounting apparatus which includes securing the base and speaker with the same fasteners.

It is another object of the invention to compressively hold the speaker cover against the base so as to prevent buzzes and rattles.

Briefly, the invention consists of a mounting base, a speaker cover, a cover retainer, and mounting means for the base and speaker. The base has an opening shaped to accommodate the speaker. The base is attached to the panel from the front; the speaker is attached to mounting posts on the base. Portions of the speaker cover are compressively held against the base by the cover retainer. The retainer and base are secured as an integral unit by releasable locking means.

DESCRIPTION OF THE DRAWINGS

For a more complete understanding of the invention, reference should be made to the drawings, in which.

DESCRIPTION OF THE PREFERRED EMBODIMENT

Figure 1:
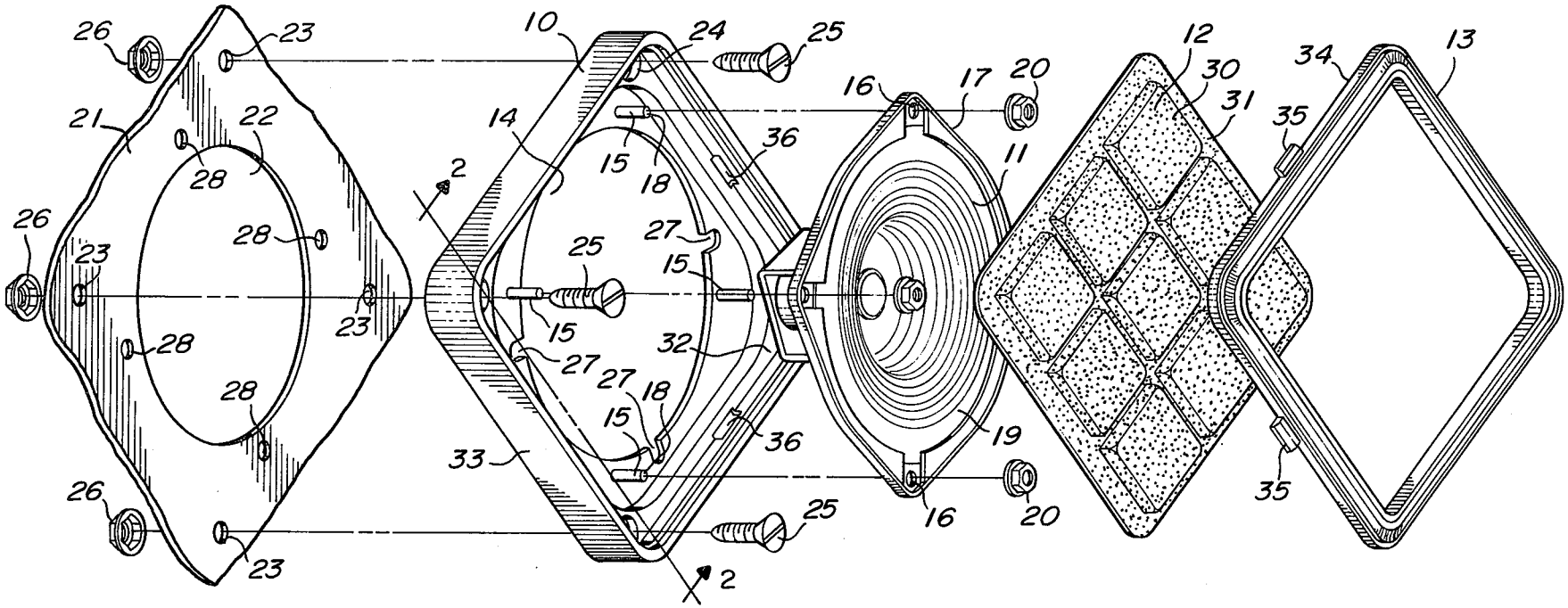
FIG. 1 is an exploded perspective view of the speaker mounting apparatus.

Referring now to the drawing in greater detail wherein like numerals have been used throughout the various views to designate similar parts, FIG. 1 illustrates the speaker mounting apparatus including a base 10, a speaker 11, a speaker cover 12, and a retainer 13 for mounting on a panel 21.

The base 10 is formed from a plastic material, such as, for example, cycolac. A central opening 14 is formed in the base 10 to accommodate the cone and related support structure 19 of speaker 11. A plurality of mounting posts 15 are disposed around the base 10 central opening 14 and are received into holes 16 on speaker 11 mounting flange 17. Ends 18 of the mounting posts 15 are adapted to receive speaker mounting clips 20 which secure the speaker 11 to the base 10. The panel 21, typically a wall panel of a recreational vehicle, contains a central opening 22 adapted to receive the speaker 11 cone and related support structure 19. The panel 21 has pilot hole locations 23 which conform to apertures 24 for screws 25 in base 10. In order to attach base 10 to panel 21, the central opening 14 of base 10 is aligned with the panel central opening 22, the base mounting apertures 24 are aligned with the pilot holes 23, and screws 25 are passed through the apertures 24 and driven into panel 21 at pilot holes 23. Alternatively, screws 25 may engage fasteners 26. The above illustrates one method of attaching the base 10 to the panel 21.

Figure 2:
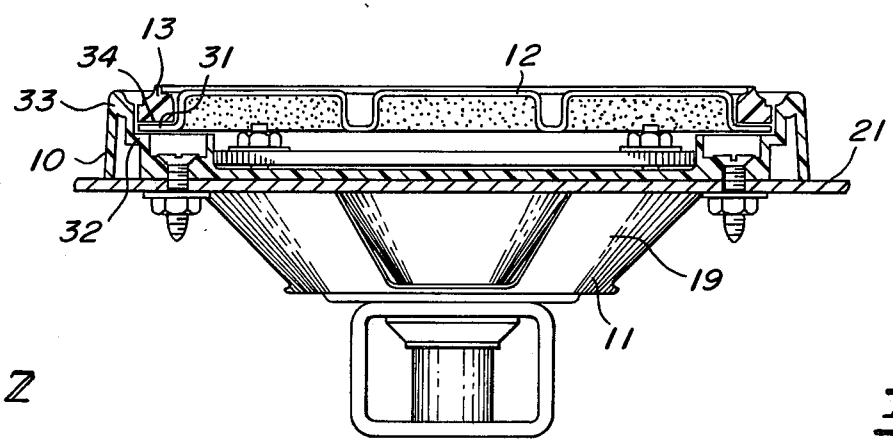
FIG. 2 is a partial cross section assembled view of the speaker and mounting apparatus.

An alternative method of simultaneously attaching the speaker 11 and base 10 to the panel 21 involves aligning the base 10 slots 27 with the panel 21 alternate pilot holes 28 which are located around the periphery of the panel central opening 22. The speaker 11 mounting holes 16 are then aligned with the base slots 27. The screws 25 are passed through the speaker mounting holes 16 and the base slots 27 and driven into the alternate pilot holes 28. This allows both speaker 11 and base 10 to be attached to the panel with the same fastening means, and provides fast and ecconomical assembly. FIG. 2 shows in greater detail a partial cross section view of the first mounting method.

Speaker cover 12 is a semirigid, decorative, accoustically efficient cover. For example, it can be formed from a decorative, fine meshed grill cover material laminated to a formed styrene backing with the backing containing a multiplicity of perforations. The raised porions 30 are formed to provide a decorative, stylish appearance. The speaker cover 12 has a peripheral flange 31 around its outer edge which when assembled into the base 10 is placed against a shoulder 32 in the base 10 and covers the speaker 11. The base shoulder 32 is formed inside a raised peripheral flange 33, the flange 33 extending outward from the base 10. FIG. 2 shows the peripheral flange 31 of the cover 12 positioned against the base shoulder 32. The cover 12 is secured against the base shoulder 32 by a resilient retainer 13 pressing the cover peripheral flange 31 against the base shoulder 32.

The resilient retainer 13 is formed, for example, from cycolac plastic. The retainer 13 has a back surface 34 which engages the peripheral flange 31 of the speaker cover 12 and biases the speaker cover against the base shoulder 32. This is accomplished by the retainer having outwardly projecting portions 35, formed in the shape of tabs for snap locking into corresponding recesses 36 formed in the inner surface of the base 10 peripheral flange 33. The retainer 13, being resilient, is deformed and the outwardly projecting portions 35 snap into the recesses 36, thereby securing the retainer and base as an integral unit. The speaker cover can be easily released by withdrawing the retainer projecting portions 35 from the recesses 36 in the peripheral flange 33 of the base 10. FIG. 2 shows in some greater detail the cooperation of the speaker cover 12, the retainer 13, and the base 10 with base flange 33 and the speaker cover peripheral flange 31.

When in place, the speaker cover 12 hides from view all the base and speaker mounting hardware, such as the screws 25 and the speaker mounting clips 20, where used, while providing an appearance similar to that of contemporary component sound systems.

Figure 3:
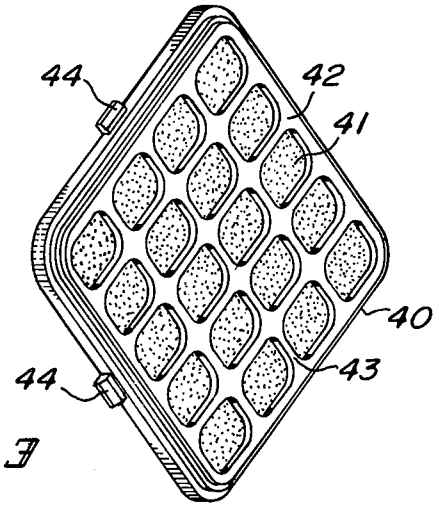
FIG. 3 is a perspective view of an integral speaker cover and retainer.

FIG. 3 shows an integral speaker cover and retainer unit 40 formed, for example, by fastening a speaker grill cloth 41 to resilient frame 42. The frame is molded of plastic material such as, for example, cycolac and contains decorative ribs 43. Tabs 44 are also formed on the outer periphery of the unit for allowing the unit to be releasably snap-fit into base 10 in the same manner as the retainer 13.

While particular embodiments of the invention have been shown and described, it should be understood that the invention is not limited thereto since many modifications may be made. It is therefore contemplated to cover by the present application any and all such modifications that fall within the true spirit and scope of the basic underlying principles disclosed and claimed herein.

I claim:

1. Apparatus for mounting a speaker having a cone on a panel having an aperture provided to receive the speaker cone, said apparatus comprising:

a base having an opening formed to receive said speaker cone and having a raised peripheral flange;

first fastening means for fastening the base to the panel;

second fastening means for fastening the speaker to the base;

a speaker cover dimensioned to fit within the base raised peripheral flange and having a peripheral flange portion;

a resilient retainer positioned within the base and engaging the speaker cover peripheral flange portion; and locking means formed between the resilient retainer and the raised peripheral portion of the base, said locking means for releasably coupling the resilient retainer and base.

2. Apparatus as claimed in claim 1 wherein the resilient retainer is a ring adapted to be contained within the base raised peripheral flange.

3. Apparatus as claimed in claim 1 wherein the speaker cover and the retainer are formed as an integral unit.

4. Apparatus as claimed in claim 1 wherein the locking means comprises interlocking projections and recesses, correspondingly arranged in predetermined relationships on the retainer and the base.

5. Apparatus as claimed in claim 4 wherein the projections comprise tabs extending outward from the resilient retainer and the recesses comprise slots contained on the interior of the base raised peripheral flange.

6. Apparatus for mounting a speaker having a cone portion comprising:

a base with a raised porion positioned around the periphery of an opening provided in said base for said speaker cone portion;

a speaker cover of predetermined dimensions to fit within the base raised portion; and retaining means for being received within the base raised portion and constraining the speaker cover to be contained therein.

7. Apparatus as claimed in claim 6 wherein the retaining means in a resilient ring and said resilient ring and base are releasably locked together by interlocking projections recesses correspondingly arranged in predetermined relationships on the resilient ring and the base.

8. Apparatus as claimed in claim 7 wherein the projections comprise tabs extending outward from the resilient retainer and the recesses comprise slots contained within the base raised portion.

9. Apparatus as claimed in claim 6 wherein the speaker cover and retaining means are formed as an integral unit.

* * * * *